United States Patent [19]

Majors

[11] Patent Number: 4,993,497

[45] Date of Patent: Feb. 19, 1991

[54] DELUGE FUNNEL TANK JACKET

[76] Inventor: Oscar R. Majors, Rte. 1, P.O. Box 61, Porter, Okla. 74454

[21] Appl. No.: 506,265

[22] Filed: Apr. 6, 1990

[51] Int. Cl.[5] ..... A62C 3/12

[52] U.S. Cl. ..... 169/66; 52/248; 220/400; 220/466; 220/88.1

[58] Field of Search ..... 169/48, 54, 66, 67, 169/68, 10; 220/5 R, 5 A, 88 R, 401, 400, 412, 426, 466, 428; 52/245, 248

[56] References Cited

U.S. PATENT DOCUMENTS

| | | | |
|---|---|---|---|
| 184,220 | 11/1876 | De St. Aubin | 169/66 |
| 1,220,106 | 3/1917 | Hartenberger | 169/66 |
| 1,874,243 | 8/1932 | Clark | 169/66 |
| 2,955,686 | 10/1960 | Blomeley et al. | 52/248 |
| 2,994,383 | 8/1961 | Gorand et al. | 169/66 |
| 4,044,517 | 8/1977 | Schroter | 52/248 |
| 4,177,863 | 12/1979 | Simon | 169/66 |
| 4,569,399 | 2/1986 | Spector et al. | 169/66 |
| 4,893,681 | 1/1990 | Flandre | 169/66 |

FOREIGN PATENT DOCUMENTS

| | | | |
|---|---|---|---|
| 1202596 | 1/1986 | U.S.S.R. | 169/66 |
| 2000022 | 4/1979 | United Kingdom | 169/66 |

OTHER PUBLICATIONS

WIPO, WO83/01200 to Sobrinho, 4/83, 169/66.

*Primary Examiner*—Sherman Basinger
*Assistant Examiner*—Stephen P. Avila
*Attorney, Agent, or Firm*—Robert E. Massa

[57] ABSTRACT

A fire fighting device having a funnel shaped jacket that attaches to a rib framing system that is strapped around a bulk storage tank, the ribs attached to a relief channel located at the base of the tank, the jacket is held away from the tank shell by the ribs, the void created between the funnel jacket and tank shell is the waterway, fire stream cooling water is collected at the top of the tank by the funnel, the water is then gravity fed through the waterway, the flow rate of the water is controlled by the size of the relief ports located in the relief channel. As the water travels across the face of the tank within the waterway, it absorbs the heat radiated into the tank by an outside heat source. The heat transferred water enters the relief channel through inlet ports. The heated water is then released outside the waterway system through relief ports. Cool fire stream water enters at the top of the funnel; heat transferred water exits the system at the base of the tank.

15 Claims, 10 Drawing Sheets

DELUGE FUNNEL TANK JACKET

FIELD OF THE INVENTION

My invention relates to fire protection systems. More particularly, my invention relates to fire protection structures built in combination with structures containing flammable products. Still more particularly, my invention relates to fire protection structures built to perform heat exchange functions in combination with a structure containing flammable products. Still more particularly, my invention relates to fire protection structures built in combination with structures containing flammable products to supply water in a heat exchange relationship to the structures containing the flammable products.

BACKGROUND OF THE INVENTION

Storage tanks of flammable liquids, such as petroleum products are commonly grouped or clustered together in an area referred to as a "tank farm". Should one of the tanks become ruptured and the contents become involved in a fire, huge quantities of heat are generated. The heat generated in the fire radiates into the surrounding tanks and their contents.

The radiated heat weakens anearby tank's outer shell and creates internal pressures, especially as the tank's contents rise in temperature. Then the rise in temperature makes the tank more vulnerable to rupture.

The most common fire fighting technique is to cool the external shell of any surrounding tanks in the tank farm which might be susceptible to extreme heat.

The most frequent cooling technique conducted is to spray large quantities of water on the tank shel. The cooling water (fire stream) is sprayed directly under high pressure onto the side of the tank.

However, the high pressure water hits the tank with such force that the wate immediately bounces back off the face of the tank. As a result, the water is in contact with the tank skin for only a short time and is very inefficient in transferring heat because of this limited contact with the tank skin.

Moreover, the fire fighter must position himself as directly as possible between the tank that is on fire and the tank that is to be cooled. Such as position is necessary in order for the fire fighter to direct his cooling water (fire stream) directly at the face of the tank skin that is receiving most of the radiated heat from the tank that is on fire.

Some of the prior provides the following references:

U.S. Pat. No. 1,220,106, Hartenberger, Mar. 20, 1917
U.S. Pat. No. 2,955,686, Blomeley et al, Oct. 11, 1960
U.S. Pat. No. 2,994,383, Gorand et al, Aug. 1, 1961
U.S. Pat. No. 4,044,517, Schroter, Aug. 30, 1977
U.S. Pat. No. 4,177,863, Simon, Dec. 11, 1979
GB No. 2,000,022, Winkler, Jan. 4, 1979
WIPO No. 83/01200, Sobrinho, Apr. 14, 1983

U.S. Pat. No. 1,220,106 to Hartenberger describes a wooden silo having a double wall construction comprising an inner lining and an outer sheathing constructed so that there is a space between them to provide for free circulation of air from air inlet doors in the bottom of the silo upwardly to an exit space provided in the conical roof of the silo.

U.S. Pat. No. 2,955,686 to Blomeley et al described a double-walled insulating structure for gasoline, fuel oil, chemicals, and similar products. In the enclosed space between the two walls, insulating material is inserted to be held in place by a series of supporting members and distance members. The insulating material, such as fiberglass or the like, also fills the space provided in the domed roof which is secured to the walls.

U.S. Pat. No. 2,994,383 to Gorand et al describes a fire protection system for an elevated structure, such as a tower, vessel, or building. The system includes a fixed nozzle, mounted generally at ground level, attached to a high pressure water system, and directed at a "chute", or water receiving member. The chute has an enlarged water receiving inlet and a restricted water outlet. The water outlet of the chute is connected to a water distribution pipe which receives the water which had been directed into the chute and permits the water to exit the pipe through a series of opening in the pipe so that water will be distributed over the surface of the elevated structure.

U.S. Pat. No. 4,044,517 to Schroter describes a tank jacketing system for a cylindrical tank comrpising a series of circular track components to which are attached individual panel members, vertically attached and with each panel member insulated with a rigid insulating member adhesively attached to the inner side of the panel. The arrangement is for heat-protecting the storage tank. The panel members and wall of the storage tank are loosely secured at the top of each by a coping disposed over the exterior of the insulating wall and innermost upper portion of the wall of the storage tank.

U.S. Pat. No. 4,177,863 to Simon describes a safety liquid dispenser which provides a combination a double walled tank body comprising an intermediate container of flammable liquid and an inner tank disposed within the intermediate container and containing pressurized carbon dioxide positioned to smother any flame condition occurring within the tank.

GB No. 2,000,022 to Winkler describes a fire-resistant container for combustibles comprising a double-walled container with the space between the walls filled with fire-extinguising material.

WIPO No. 83/01200 to Sobrinho describes a trough-like collar affixed to an upper external rim of a fuel tank which includes a plurality of overflow holes. A water supply pipe is in position to supply water to the trough of the collar from which the water may exit the holes and flow down the side of the tank.

SUMMARY LOF THE INVENTION

The primary object of my invention is to provide a fire protection system which is inexpensive, easy to assemble, and efficient.

Another object of my invention is to provide a fire protection structure which will provide superior safety in use in combination with a storage tank of flammable products.

Still anothe object of my invention is to provide a protective structure for another structure which contains flammable products in a manner that the protective structure will easily and efficiently distribute a cooling liquid over the structure containing the flammable products.

Still another object of my invention is to provide a fire protection system which will provide superior safety to a fire fighter who is trying to prevent a fire from occurring in a storage tank shielded by the fire protection system.

I have designed my funnel and jacket to collect cooling water (fire stream) and distribute it around the entire tank shell. My invention comrpises a steel outer jacket and funnel component attached to the storage tank.

In one preferred embodiment of my invention I have combined a jacket component with a funnel component of a greater sectional diameter than the jacket portion, and by doing this, I have designed the funnel component to cooperate with and rest upon the top of the jacket member. From a cooperating position on the top of the jacket, the lower portion of the funnel is conically extended outwardly in relation to the jacket to a larger, cylindrical portion, and there, at a chosen extent, is extended upwardly in a cylindrical manner substantially parallel to the cylindrical jacket, to form a larger cylinder.

Thus, the flared top of this embodiment provides a larger stream collection area than if the collection component had sides extending in line with the sides of the tank.

The jacket portion is slightly larger in diameter than the tank and surrounds the tank with an air space between the tank shell and the jacket.

The shape of the storage tank can be of any form or contour, thus the jacket simply follows the shape of the tank. For example, the tank could also be a mobile tank such as a transport or rail tank car.

But, no matter what the shape of the protective jacket, the funnel which rests upon the jacket must have a horizontal cross-sectional area greater than any horizontal cross-sectional area of the water distributing jacket enclosing the storage tank in order to supply sufficient cooling water to the side of the storage tank.

In the basic construction of my jacket system for an upright cylindrical storage tank, I have designed the jacket member to comprise a series of plates which are held loosely in position by the adaptation of a series of horizontal channel members which encircle the storage tank and a series of vertical channel members spaced around the outside of the vertically positioned cylindrical tank. The encircling horizontal channel members and the vertically positioned channel members are held in secure position where they meet.

All of the horizontal channel members and all of the vertical channel members have openings, or ports, along the side which provide the means for communication of the cooling stream from the funnel member downwardly along the side of the jacket and eventually exiting through the lowest horizontal channel member.

In further description, this means that the fire stream water collecting in the cone-shaped funnel flows downwardly in the space provided between the storage tank and the jacket. Technically 100% of the water flowing into the funnel is utilized in transferring heat from the tank to the fire stream water.

The channel ports are designed as may best provide an efficient flow of water downwardly between the tank and the jacket by the flow of the water between horizontal channel members and vertical channel members.

For another embodiment of my invention which I am disclosing, I have adapted my concept to a horizontally disposed storage tank. In this embodiment I have provided similar channel members which substantially encircle the storage tank and are in communication with a collection funnel on top of the tank which has a pyramidal lower section adjacent the tank and a rectangular upper portion which has a larger cross-sectional area than the largest cross-sectional area of the tank. As described above, each channel member includes means for loosely supporting a plate member while providing a space between the plates and the storage tank. Then, each channel member also has openings that permit the flow of cooling water throughout the jacket and then exit through a lower horizontal channel member.

I also conceive, for some applications, the use of an upper funnel member along, on top of a storage tank, without being attached to a jacket component.

In the use of my invention, the source of the cooling water (fire stream) can be hand lines, truck mounted nozzles, or a pre-piped standpipe system.

Regardless of the source of water, the fire fighter is able to position himself safely away from the fire in order to supply the cooling water to the deluge funnel jacket. The fire fighter places himself on the back side of the tank requiring cooling, which is the opposite side of the tank face that is exposed to the external heat source.

DESCRIPTION OF THE PREFERRED EMBODIMENTS

Figure 2:
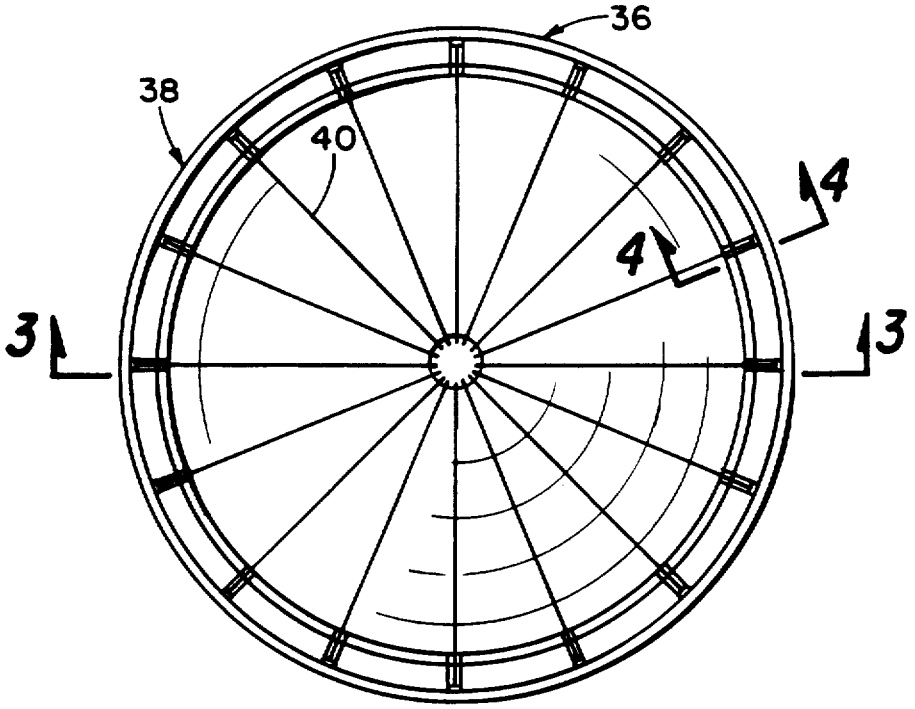
FIG. 2 is a top view of a funnel jacket system according to my invention along the lines 2—2 of FIG. 1.
Figure 1:
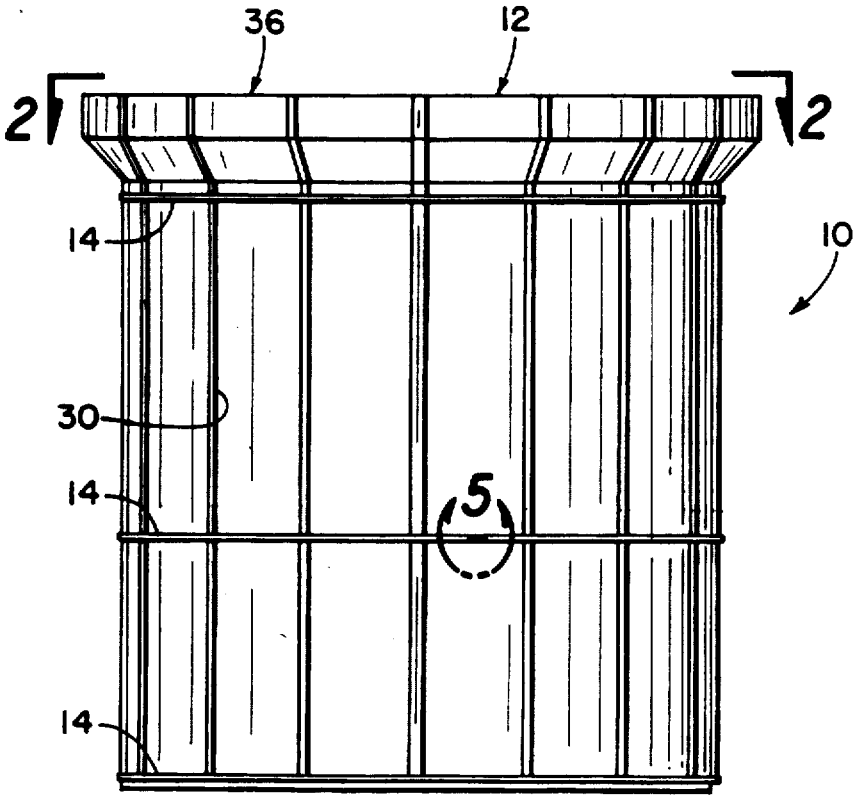
FIG. 1 is a side elevational view of a vertical funnel jacket system according to my invention as it would be enclosing a vertical storage tank.
Figure 3:
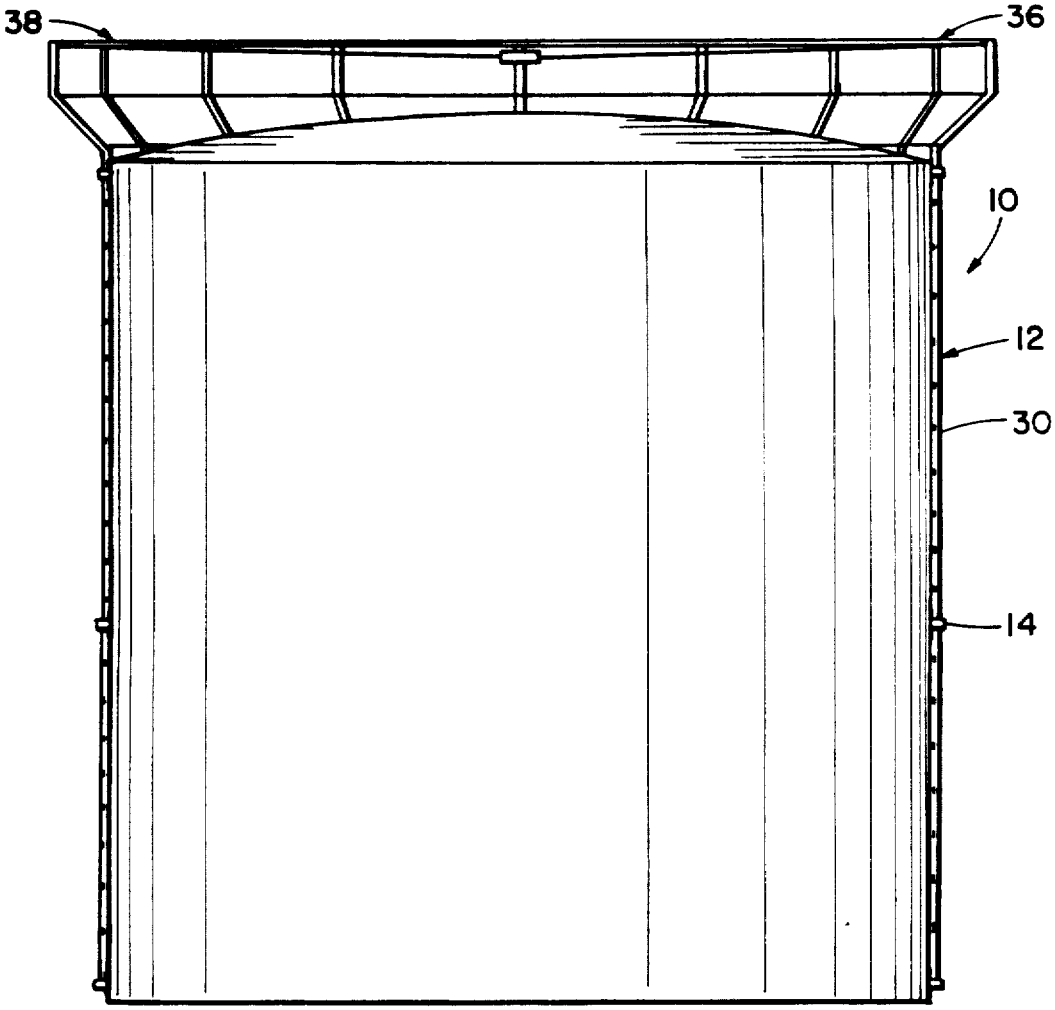
FIG. 3 is a cross-sectional view of a funnel jacket system according to my invention along the lines 3—3 of FIG. 2.

FIG. 1 describes a first embodiment of a water collecting and distributing jacket in combination with a storage tank 10, generally, with the funnel jacket system 12, generally, enclosing a typical vertical storage tank for flammable liquids as I have described above, knowing tht a typical storage tank is not shown generally in my drawings, but only where necessary, being shown in portions where there is a need to show the cooperation of storage tank components with components of my funnel jacket system 12, generally.

Figure 5:
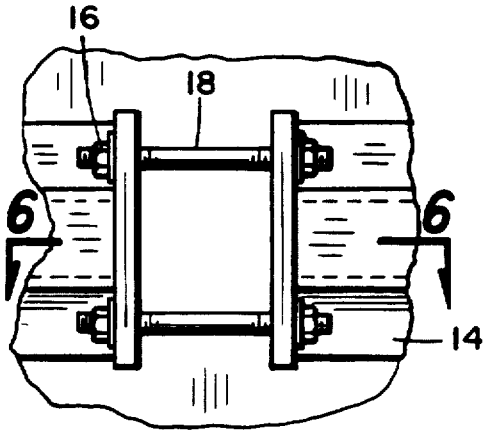
FIG. 5 is an enlarged elevational view within the circumscribing circle 5 of FIG. 1 showing tension connection for components of my invention.
Figure 6:
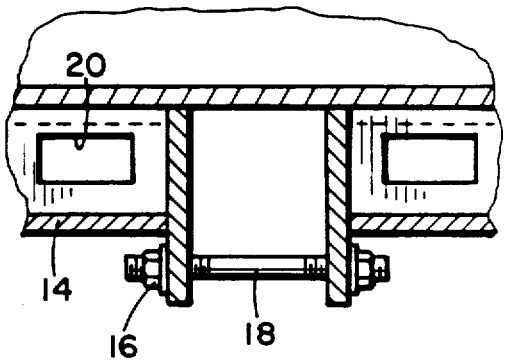
FIG. 6 is a top cross-sectional view along the lines 6—6 of FIG. 5.

My system comprises a plurality of horizontally encircling channel members 14, position as shown in FIG. 1, and held tensionably in position as shown in FIG. 5 with nuts and bolts 16 and 18 respectively, and with each channel member including a plurality of side openings 20 in order to provide for ciruclation of water being collected at the top of the funnel jacket system.

Figure 4:
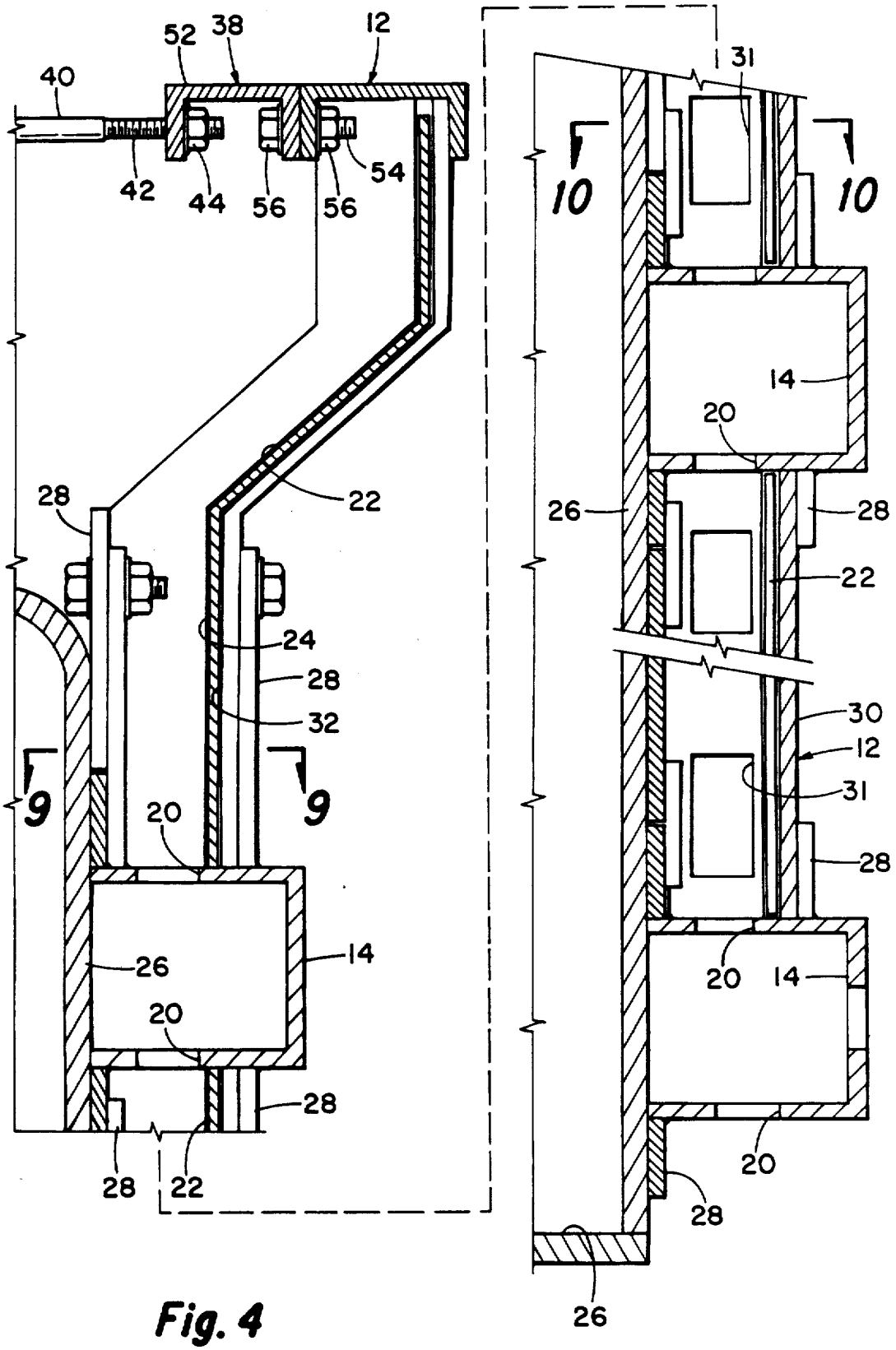
FIG. 4 is a cross-sectional view of a portion of a funnel 3acket system according to my invention along the lines 4—4 of FIG. 2 showing the cooperation of a funnel, a jacket, and storage tank components.

Each horizontal channel member 14 has the typical channel configuration as shown in cross-section in FIG. 4.

As may be easily seen in the cross-sectional lengthwise view of the funnel jacket system 12, generally, shown in FIG. 4, each channel member 14 provides a space 22 between each jacket plate 24 and wall 26, through which cooling water may easily flow as I have described above.

I prefer to attach the channel member 14 as by prior welding to anchor members 28 which had been been secured to the outer wall of the storage tank.

Figure 10:
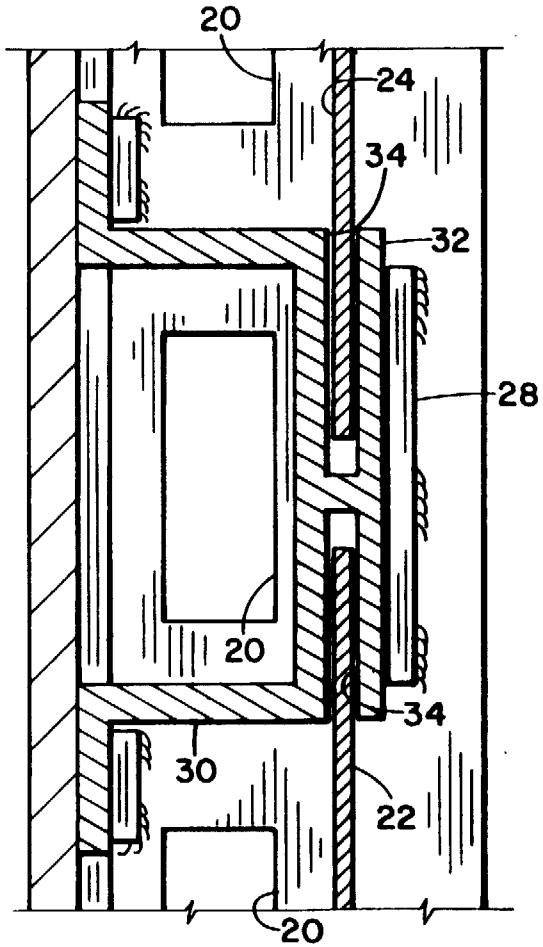
FIG. 10 is a cross-sectional view along the lines 10—10 of FIG. 4 of my invention showing a lower portion of the jacket and storage tank.
Figure 9:
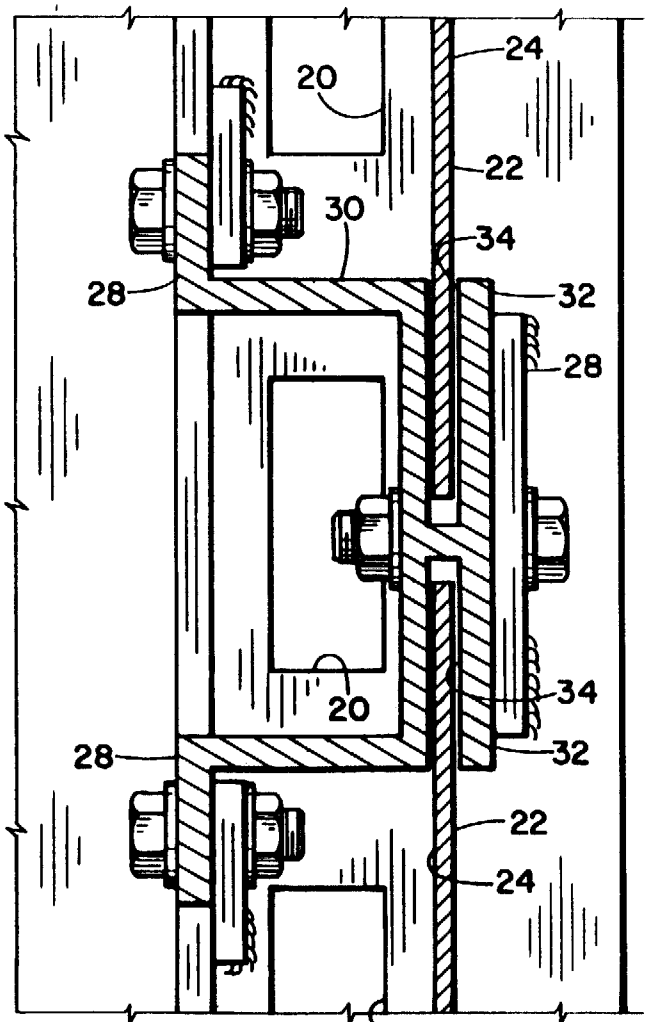
FIG. 9 is a cross-sectional view along the lines 9—9 of FIG. 4 of my invention showing an upper portion of the jacket and storage tank.

As I show most clearly in FIGS. 9 and 10, jacket plates 24 are held loosely in position by the channel members 14 by means of an anchor plate 28 secured to each channel member 14 and to each vertical channel member 30, as shown in FIG. 4. I also show side openings 31 in vertical channels 30.

Each vertical channel member as shown in FIGS. 9 and 10 includes a slot plate 32 positioned lengthwise of the channel 30 which provides a vertical slot 34 for loosely holding each jacket plate 24.

The lower horizontal channel 14, as shown at the bottom-most portion of FIG. 4, has side openings 20 near the gorund to act as relief channel for exit of cooling water.

At the top of the funnel jacket system 12, generally, I have positioned a funnel member 36, generally, as shown in FIGS. 1, 2, 3, 4, 7, and 8. The outer portion is an outwardly extending portion of the vertical channel members with jacket plates, as clearly shown in FIG. 4, and is ringed by an encircling cap member 38, generally, which encircles the top of the funnel and includes tension means for holding the top of the funnel in substantially rigid position.

I have designed the tension means to include a series of threaded rods 40 held adjustably at one end by a nut and bolt connection 42 and 44, and converging near the center of the funnel at a tension ring 46, to which the rods 40 are held adjustably by threaded portion 48 and bolt 50.

Figure 7:
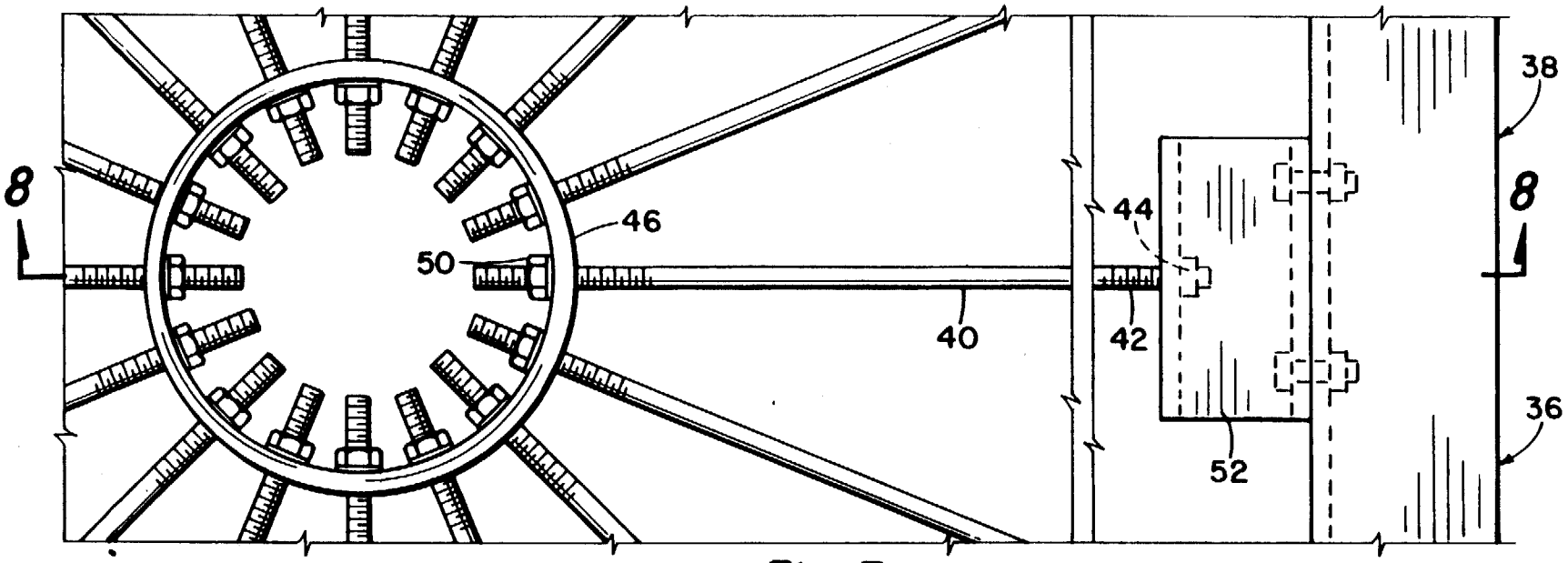
FIG. 7 is an enlarged top view of an upper tension portion of the funnel member according to my ivnention.
Figure 8:
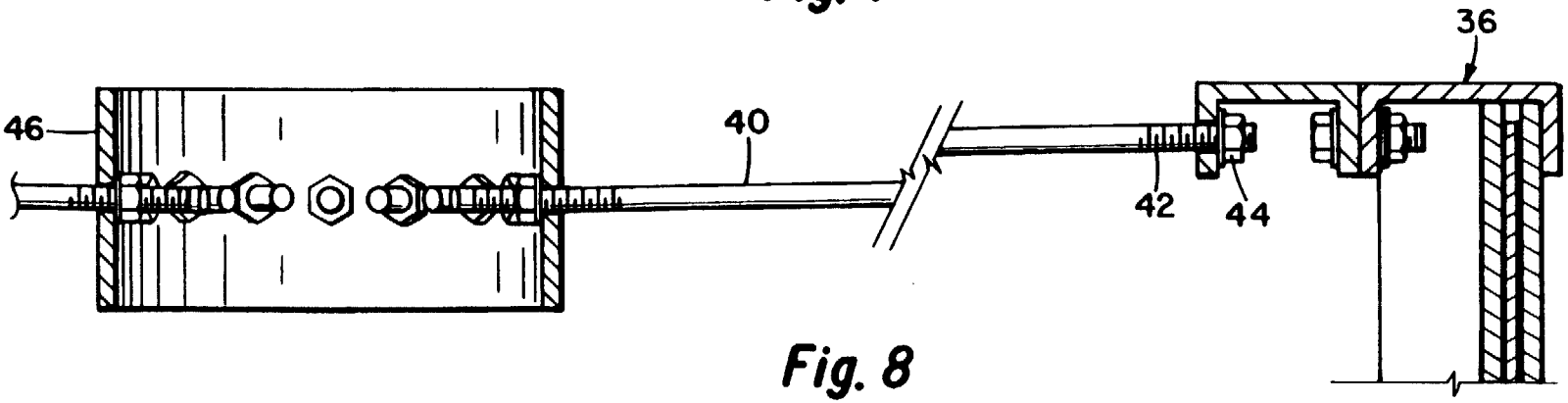
FIG. 8 is a cross-sectional view along the lines 8—8 of FIG. 7 of the tension member according to my invention.

As I suggest in FIG. 7, the securing means for tension may also be provided by use of a separate securing component 52 secured to the interior of the funnel cap and held by nut and bolt 54 and 56.

In FIGS. 11 through 19, I have described the application of my invention to a horizontally disposed storage tank.

Figure 11:
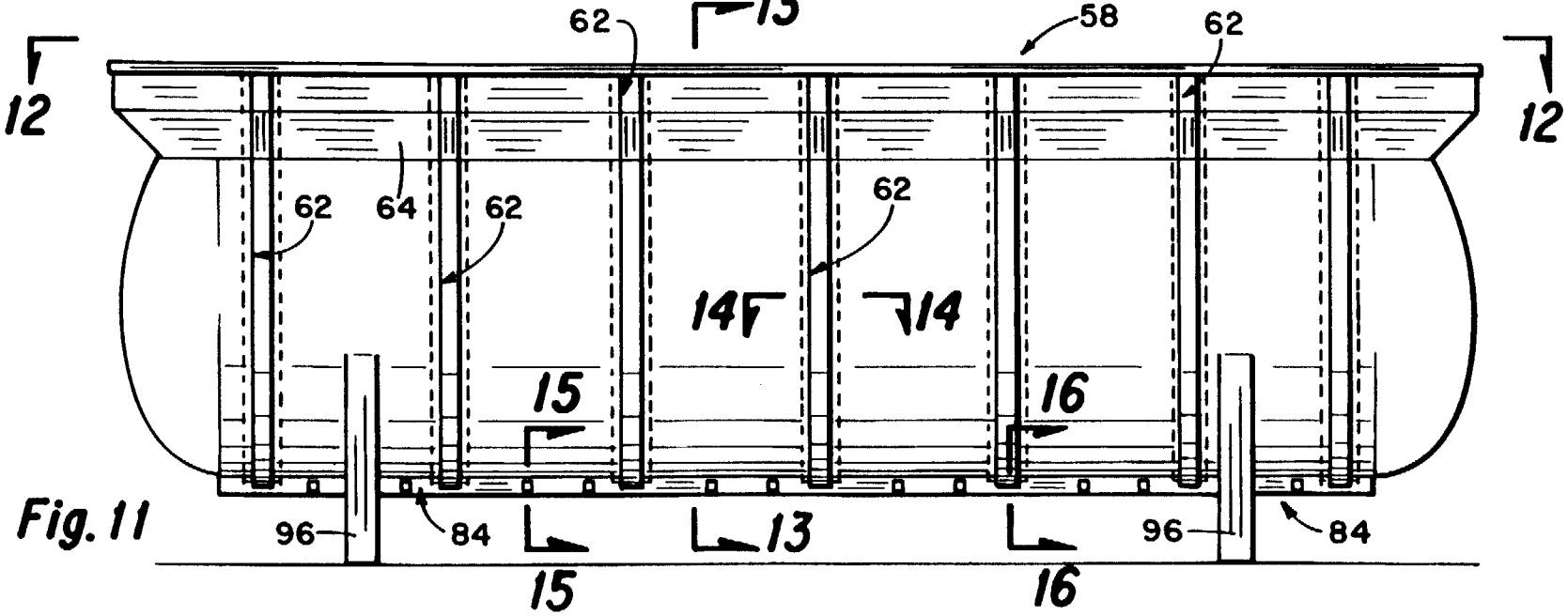
FIG. 11 is a side elevational view of a horizontal funnel jacket system according to my invention as it would be enclosing a horizontal storage tank.

In FIG. 11 I am showing a water collecting and distributing system 58, generally, as I had described above, in combination with a horizontally positioned storage tank, with the storage tank not being shown in its entirety but knowing that the funnel and jacket system encloses a storage tank. Exposed portions of a storage tank 60 are shown in FIG. 12.

As I have described initially, and with respect to the vertical storage tank, I have designed my horizontal jacket system 58, generally, to be essentially built from a plurality of encircling channel members 62 which I designed to hold loosely jacket plates 64.

Figure 14:
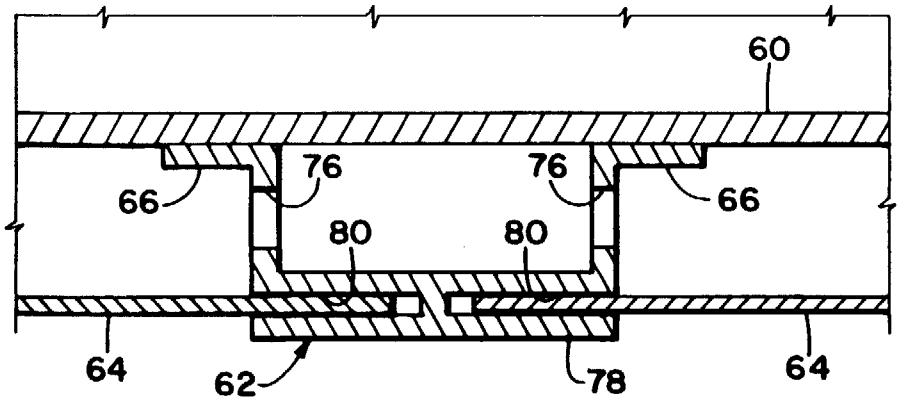
FIG. 14 is a cross-sectional view along the lines 14—14 of FIG. 11 of a funnel jacket system according to my invention showing cooperation of jacket and storage tank components.
Figure 12:
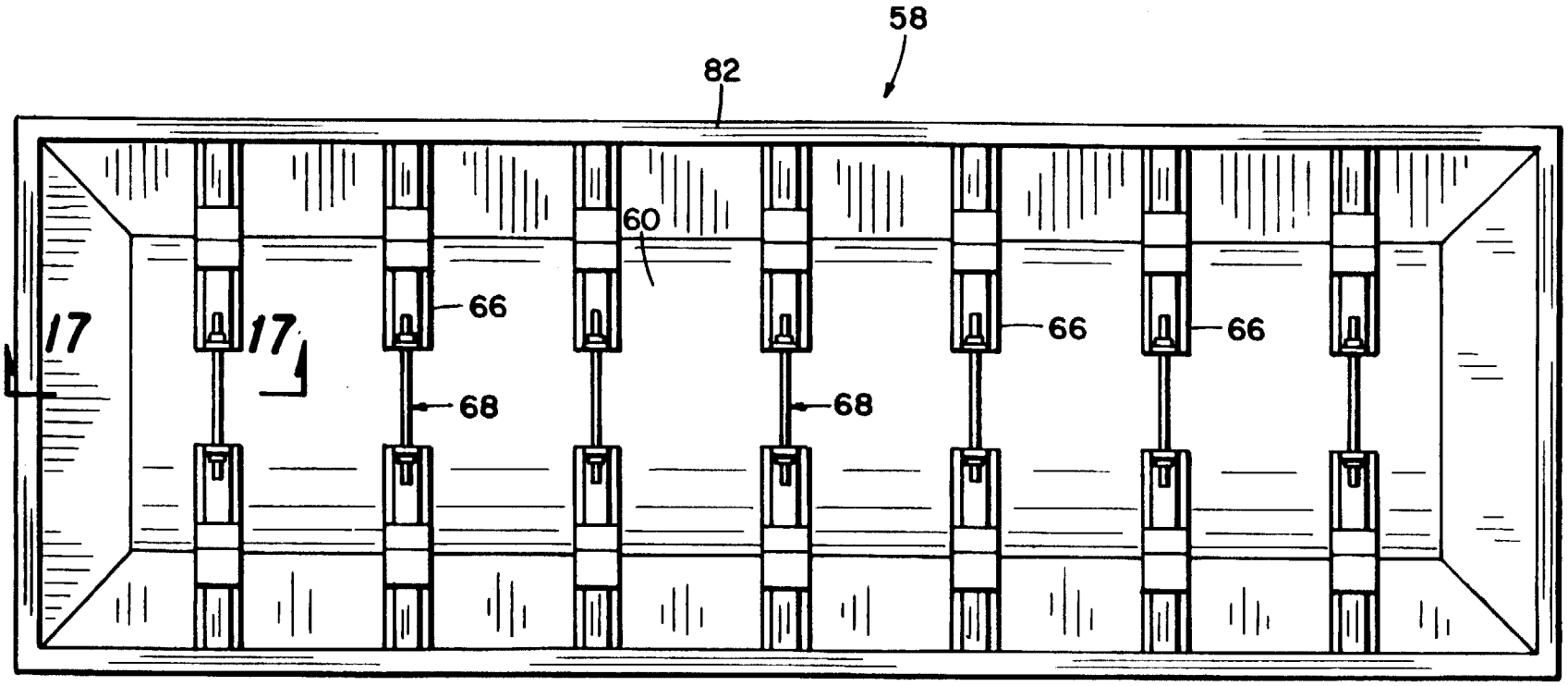
FIG. 12 is a top view of a funnel jacket system according to my invention along the lines 12—12 of FIG. 11.
Figure 13:
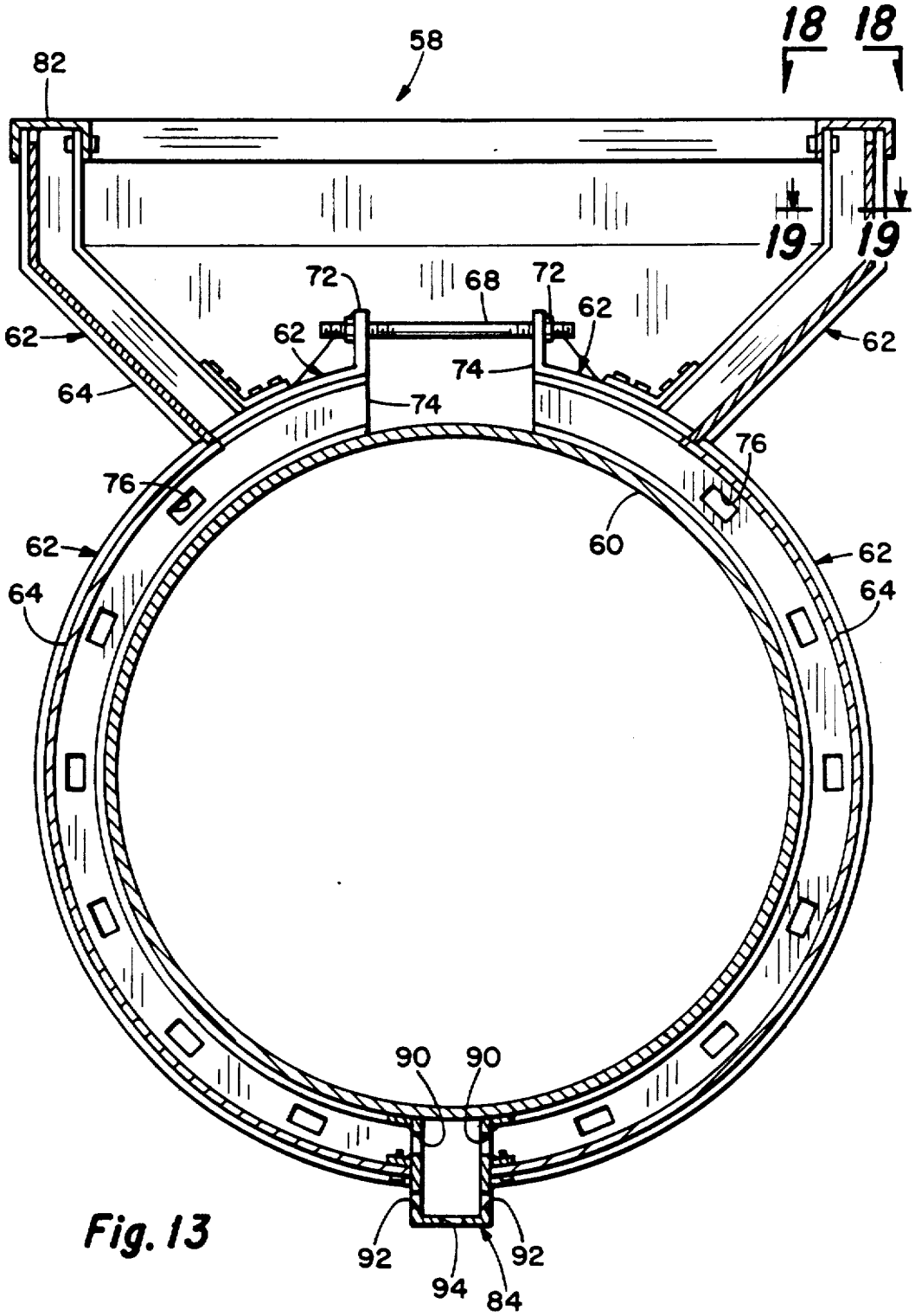
FIG. 13 is a cross-sectional view of a funnel jacket system according to my invention along the lines 13—13 of FIG. 11.
Figure 18:
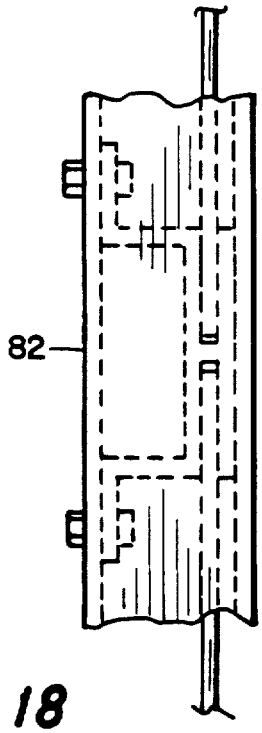
FIG. 18 is atop view along the lines 18—18 of FIG. 13 of a top portion of a funnel jacket system according to my invention.
Figure 19:
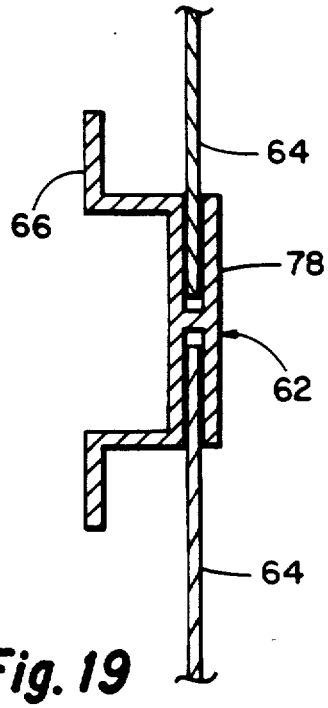
FIG. 19 is a cross-sectional view along the lines 19—19 of FIG. 13 of a side poriton of a funnel member of a funnel jacket system according to my invention.
Figure 15:
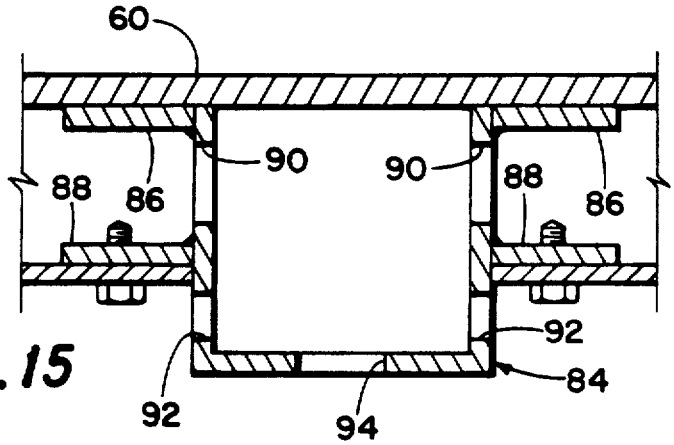
FIG. 15 is a cross-sectional view along the lines 15—15 of FIG. 11 according to my invention showing cooperation of a lower relief channel with a storage tank.
Figure 16:
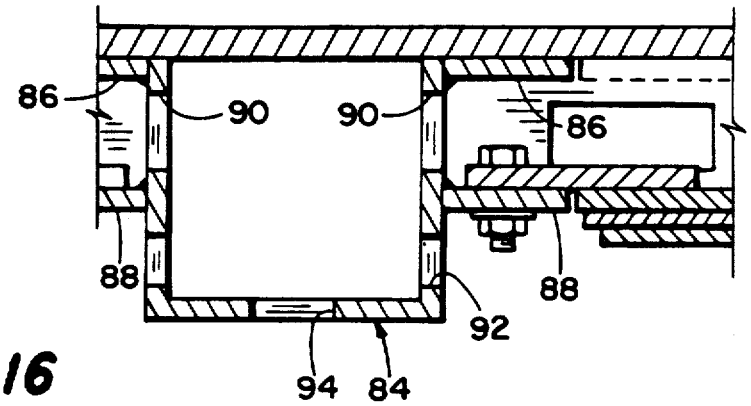
FIG. 16 is a cross-sectional view along the lines 16—16 of FIG. 11 showing cooperation of a portion of an outer jacket with a side channel member and lower relief channel.

As I have shown clearly in the cross-sectional view of FIG. 14, I have secured each channel member 62 to the storage tank 60, preferably by welding each channel wing 66 to the exterior of the storage tank 60, if desired, or relying upon the tension supplied by a tnesion component 68, generally, shown in FIGS. 12 and 13.

Tension member 68 comprises a threaded member 70 secured at each end by means of bolts 72 after threaded member 70 has passed through upright member 74 secured at each end of channel 62.

Each channel member 62 has a plurality of side openings 76 as shown in FIGS. 13 and 14. Channel members 62 include an extended plate portion 78 which provides a slot portion 80 with channel 62 which holds jacket plates 64.

Figure 17:
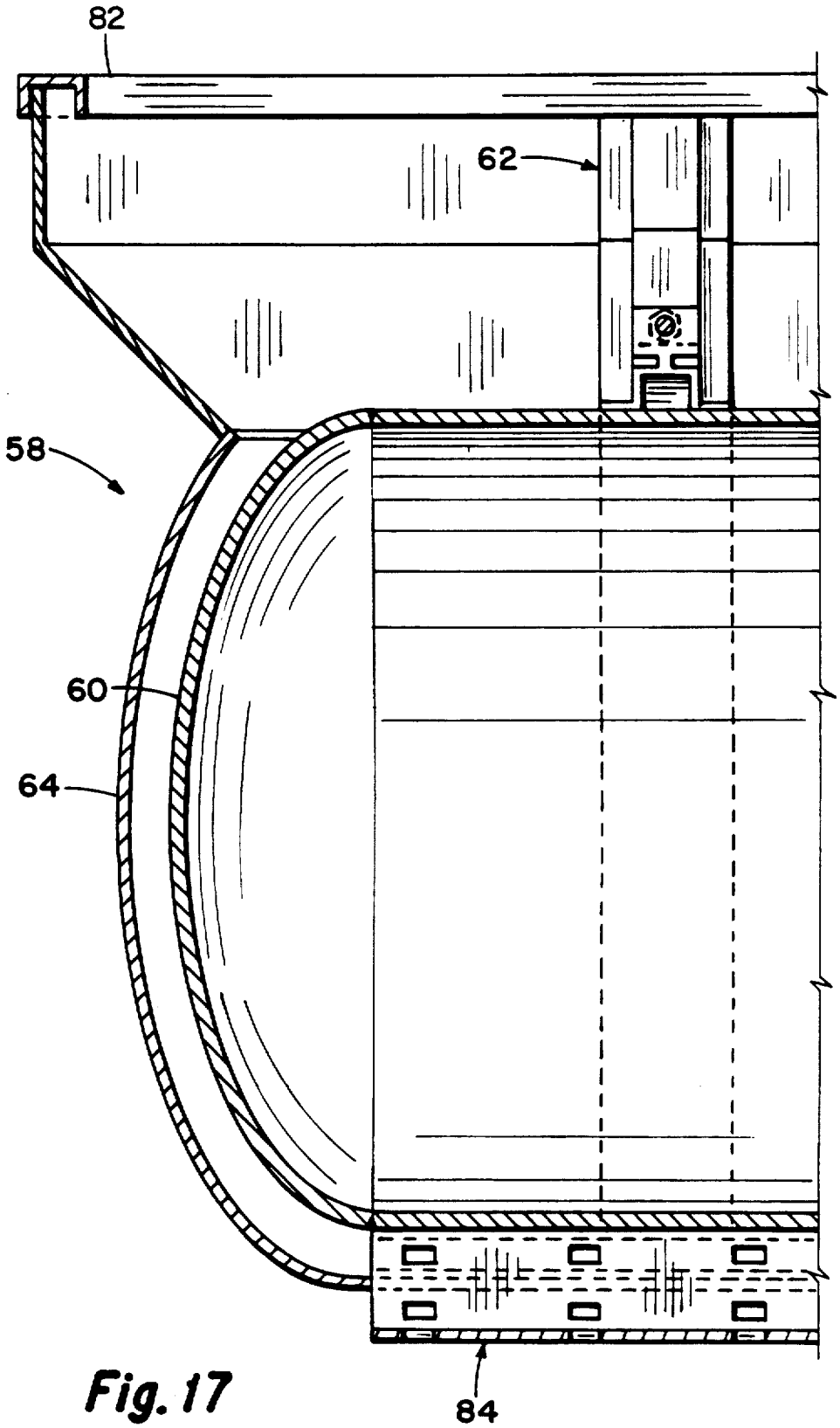
FIG. 17 is a cross-sectional view along the lines 17—17 of FIG. 12 of an end portion of a funnel jacket system according to my invention.

Then, as shown in FIGS. 13 and 17, channel members 62 provide a space between the storage tank and the protecting jacket plates 64 so that water may more easily circulate around the storage tank.

The jacket plates 64 and channel members 62 are additionally secured in position by a channel cap member 82.

A lower relief channel 84 extends substantially lengthwise along the bottom of the horizontal system to provide for exit of the heated water having passed over the surface of the storage tank.

Relief channel 84 includes channel wings 86 secured to the storage tank 60, and channel wings 88. Channel 84 also includes a plurality of openings, including side openings 90, lower exit openings 92, and bottom openings 94.

As I suggest in FIG. 11, the storage tank and its protective cover might rest upon a typical set of concrete or steel supports 96.

In some of the figures I have exaggerated the dimensions of certain components, such as the radii of circular units because of the relationship of the scale of channels and other units to the size of the entire structure in order to give added clarity to my drawings. For example, where small protions of a circular tank are shown in the figure, that circular portion is shown as a straight line.

Since many different embodiments of my invention may be made without departing from the spirit and scope thereof, it is to be understood that the specific embodiments described in detail herein are not to be taken in a limiting sense, since the scope of the invention is best defined by the appended claims.

I claim:

1. A water collecting and distributing protective jacket in combination with a storage tank, comprising:

a plurality of channel members substantially surrounding the storage tank, each channel member having means for receiving and and loosely holding in position an edge portion of a jacket plate component at a distance from the tank to create a void between the jacket and the storage tank, each channel member having a plurality of side openings to permit water to flow from a channel member into the void, a funnel positioned on top of the water jacket forming an enclosure for collecting water and having means for permitting communication of water flow from the enclosure of the funnel into the void, the funnel having a horizontal sectional demension at least equal to a horizontal sectional dimension of the storage tank, and a horizontally disposed channel member near the lowest portion of the jacket in communication with the void, the horizontally disposed channel member having a plurality of relief ports to permit water flowing through the void to exit the jacket.

2. A water collecting and distributing protective jacket as described in claim 1, wherein:

the jacket is of similar contour to the contour of the storage tank.

3. A water collecting and distributing protective jacket as described in claim 2, wherein:

the storage tank is a vertical cylindrical tank and the jacket is vertically disposed around the tank.

4. A water collecting and distributing protective jacket as described in claim 3, wherein:

the funnel has an upper cylindrical portion having a larger diameter than the diameter of the storage tank and has a lower conical portion attached to the top of the jacket.

5. A water collecting and distributing protective jacket as described in claim 4, wherein:

the jacket includes a plurality of horizontally disposed channel members and a plurality of vertically disposed channel members cooperating with each horizontally disposed channel member in holding the channel members and jacket plate members in position.

6. A water collecting and distributing protective jacket as described in claim 5, wherein:

the water jacket includes a plurality of adjustable tension members connected diametrically across the top of the funnel, each tension member adjustably secured at one end to a funnel cap and adjustably secured at the other end to a tension ring at the planar center of the funnel.

7. A water collecting and distributing protective jacket as described in claim 1, wherein:

the storage tank is a horizontally disposed storage tank and the jacket is horizontally disposed around the tank.

8. A water collecting and distributing protective jacket as described in claim 7, wherein:

the funnel has an upper rectangular portin having a larger cross-sectional area than the largest cross-sectional area of the storage tank and a lower pyramidal portion attached to the top of the jacket.

9. A water collecting and distributing protective jacket as described in claim 8, wherein:

each channel member includes means for adjusting the tension of the channel member.

10. A water collecting and distributing protective jacket as described in claim 9, wherein:

the means for adjusting the tension of each channel member comprises a threaded component at the upper end of each channel member cooperating with a threaded component of an opposite channel member.

11. A water collecting and distributing portective jacket as described in claim 10, wherein:

the upper ends of each channel member are within the pyramidal poriton of the funnel.

12. A wate collecting and distributing funnel in combination with and positioned upon a storage tank, comprising:

a plurality of vertically extending channel members and a plurality of plate members cooperating in forming an enclosure for collecting water and having means for permitting exiting of water from the enclosure of the funnel, each vertically extending channel member having means for receiving and loosely holding in position, in cooperation with an adjacent vertically extending channel, an edge portion of a plate member to form the funnel structure, an uppermost cap member to which each channel member is secured, and the funnel having a horizontal sectional dimension across its lowest section greater than the horizontal sectional dimension of the storage tank.

13. A water collecting and distributing funnel as described in claim 12, wherein:

each channel member includes a side opening for permitting exiting of water from the enclosure from lower portions of the funnel down a side of the storage tank.

14. A water collecting and distributing funnel as described in claim 13, wherein:

the funnel includes a plurality of adjustable tension members connected diametrically across the top of the funnel, each tension member adjustably secured at one end to a funnel cap and adjustably secured at the other end to a tension ring at the planar center of the funnel.

15. A water collecting and distributing funnel as described in claim 13, wherein:

the funnel includes a plurality of adjustable tension members securing opposite channel members.

* * * * *